United States Patent [19]

Kastner

[11] 4,103,676

[45] Aug. 1, 1978

[54] GREASE EXTRACTION CARTRIDGE FOR KITCHEN EXHAUST VENTILATOR

[76] Inventor: Karl F. Kastner, 6025 Smokey Canyon Dr., Sun Valley, Nev. 89431

[21] Appl. No.: 738,359

[22] Filed: Nov. 3, 1976

[51] Int. Cl.[2] ..... F24C 15/20

[52] U.S. Cl. ..... 126/299 E; 55/242; 55/436; 55/440; 55/DIG. 36

[58] Field of Search ..... 126/299 R, 299 D, 299 E; 55/DIG. 36, 436, 440, 443

[56] References Cited

U.S. PATENT DOCUMENTS

| | | | |
|---|---|---|---|
| 1,347,374 | 7/1920 | Hudson | 55/440 X |
| 3,021,777 | 2/1962 | Smith | 126/299 D |
| 3,176,605 | 4/1965 | Jenson | 126/299 D |
| 3,410,195 | 11/1968 | King | 126/299 E |
| 3,433,146 | 3/1969 | Russell | 126/299 E |
| 3,667,371 | 6/1972 | Russell | 126/299 D |
| 3,786,739 | 1/1974 | Wrighy | 126/299 E |

*Primary Examiner*—William F. O'Dea
*Assistant Examiner*—Harold Joyce
*Attorney, Agent, or Firm*—Clarence O'Brien; Harvey B. Jacobson

[57] ABSTRACT

A grease extraction cartridge for a kitchen exhaust ventilator is removably disposed along a flow path through the ventilator for normally forming a fire wall, while being readily removable from the ventilator to permit access to the interior of the ventilator for purposes of cleaning and maintaining the device.

4 Claims, 6 Drawing Figures

12
28
36
32
26
24
22
10
24
38
66
18
88
94
58
54
66
40
64
14
66
16

26
30
28
18
12
36
34
C
44
46
22
10
24
38
50
72
84
88
86
66
44
20
90
A
48
108
60
92
40
56
66
106
14
66
52
54
64
B
42
112
104
110
16

GREASE EXTRACTION CARTRIDGE FOR KITCHEN EXHAUST VENTILATOR

BACKGROUND OF THE INVENTION

1. Field of the Invention

This invention relates generally to ventilators, and particularly to a removable grease extraction cartridge for a kitchen exhaust ventilator.

2. Description of the Prior Art

Kitchen exhaust ventilators have been built over many years in variour forms for removing smoke and grease polluted air from the cooking area of a kitchen. The removal of the air is accomplished in a fairly easy manner, but by exhausting the air that is saturated with grease a new problem is created. The grease deposits itself inside the ventilator, and thus causes many grease fires in restaurants and similar commercial establishments. Different manufacturers are employing various systems, generally employing a water wash, to minimize the fire danger. Examples of such ventilators can be found in U.S. Pat. Nos. 3,433,146 and 3,667,371, both issued to K. S. Russell on Mar. 18, 1969, and June 6, 1972, respectively. In particular, the known ventilating apparatuses disclosed in these two prior patents employ a removable filtering element in conjunction with a water wash system in order to collect the grease in the filter for subjection to the water wash.

U.S. Pat. No. 3,410,195, issued Nov. 12, 1968, to D. E. King, discloses a kichen exhaust hood having an arrangement similar to those shown in U.S. Pat. Nos. 3,433,146 and 3,667,371, inasmuch as a water wash is shown in combination with a drip-proof louver formed by a plurality of louvered sections removably arranged at the entrance to the hood.

It is also known to construct a kitchen exhaust ventilator wherein the air flow moves first downwardly through a first filter element and then upwardly toward exhaustion, while being washed by a water spray all the while. A difficulty encountered with this known ventilator, however, is that access to some interior parts of the device is almost impossible, and cleaning of the unit is rather tedious due to permanently installed filtering elements.

SUMMARY OF THE INVENTION

It is an object of the present invention to provide a kitchen exhaust ventilator which affords easy and complete access into the interior of the ventilator in order to facilitate periodic inspection and maintenance of the unit.

It is another object of the present invention to provide a kitchen exhaust ventilator including an effective fire wall which is displaceable to provide access to the interior of the unit.

It is still another object of the present invention to provide a grease extraction cartridge for use with a kitchen exhaust ventilator which forms a fire wall for the ventilator while being removable in order to permit complete access to the interior of the unit.

These and other objects are achieved according to the present invention by providing a grease extraction cartridge removably mountable between the entry and lower chamber of a kitchen exhaust ventilator for forming a fire wall between the entry chamber and an upper chamber of the ventilator. In addition, a further grease extraction cartridge can be mounted in the rear of the housing of the ventilator along the flow path between the lower chamber and the upper chamber for providing further cleaning of air passing through the unit. Removal of the primary grease extraction cartridge from the unit will permits selective removal of the further cartridge from the housing of the ventilator for purposes of cleaning and inspection.

Each of the grease extraction cartridges includes a support, an airfoil mounted on the support and arranged for changing the direction of flow of fluid over the airfoil in order to collect grease, and the like, on the surfaces of the airfoil, and a connector system provided on the support for removably mounting the support in the housing of a kitchen exhaust ventilator.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
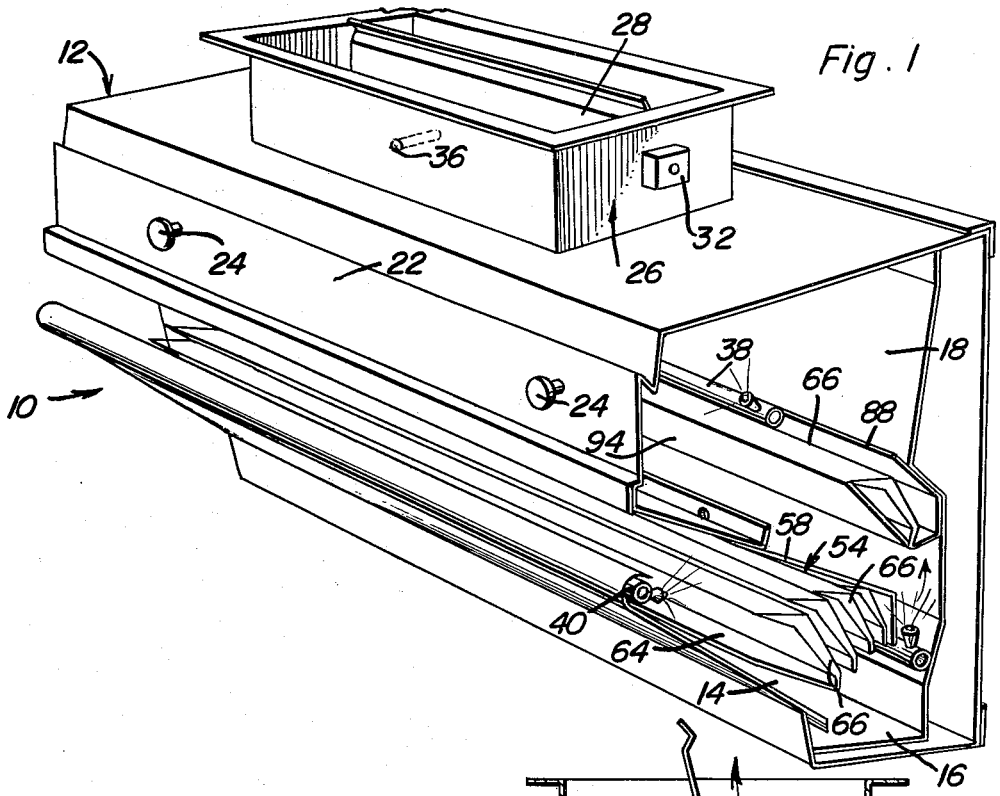
FIG. 1 is a fragmentary, perspective view showing a kitchen exhaust ventilator provided with grease extraction cartridges according to the present invention.
Figure 2:
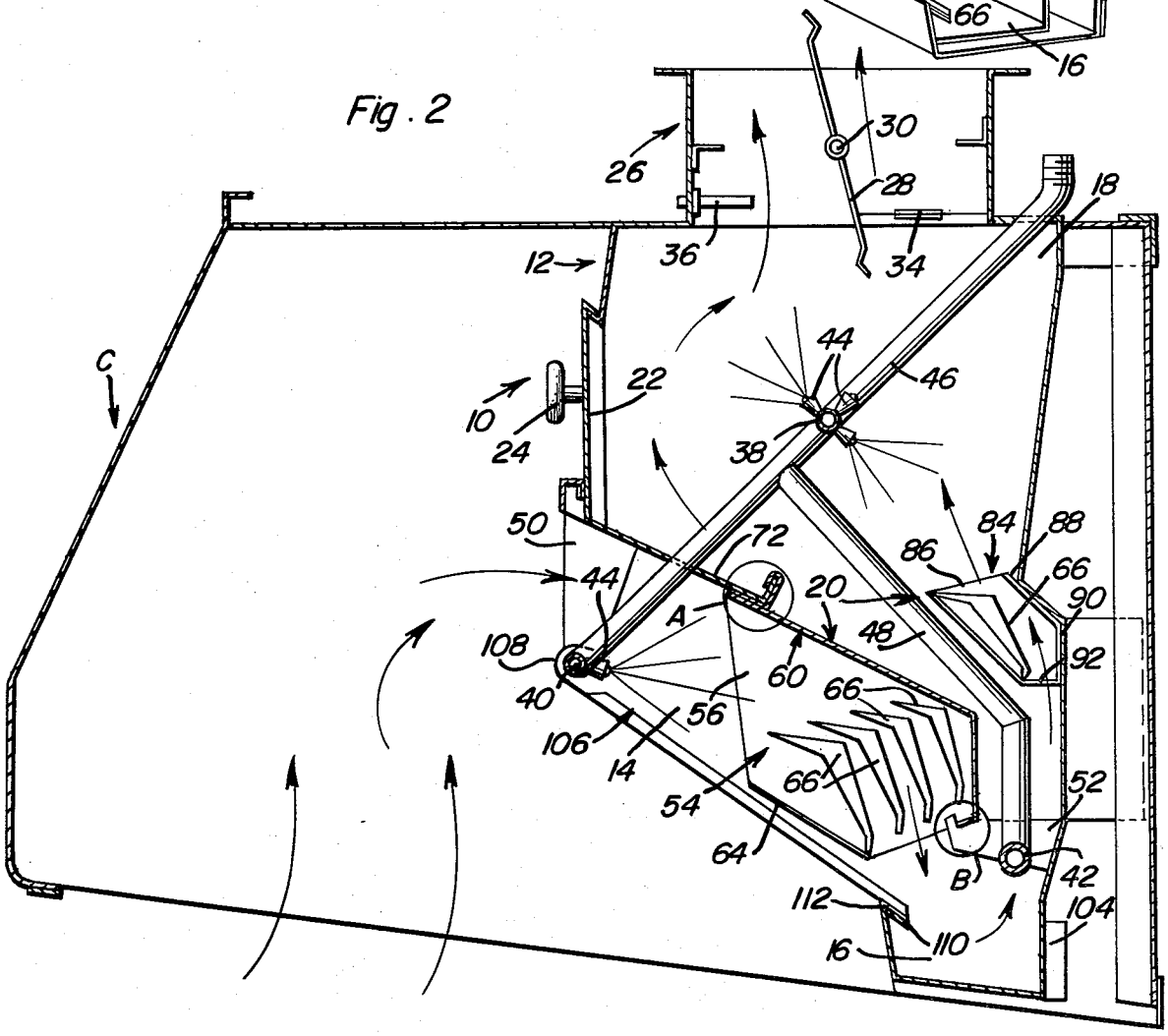
FIG. 2 is an enlarged, end elevational view looking from the right in FIG. 1, and shown together with a conventional canopy as usually employed with a kitchen exhaust ventilator.
Figure 3:
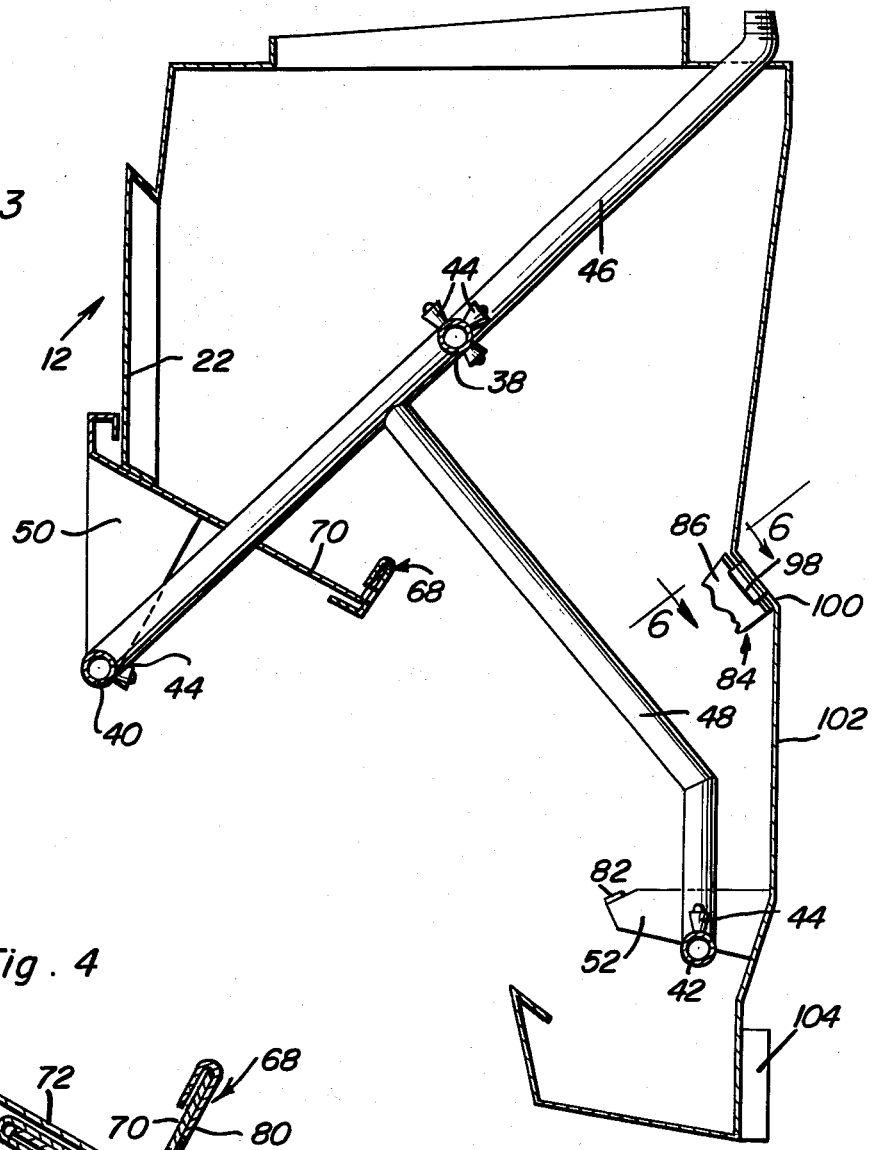
FIG. 3 is an enlarged, end elevational view similar to FIG. 2, but with the hood and the grease extraction cartridges removed.

Referring now more particularly to FIGS. 1 through 3 of the drawings, a kitchen exhaust ventilator 10 according to the present invention includes a housing 12 which partially forms an entry chamber 14, a lower chamber 16, and an upper chamber 18. A flow path of polluted air from a stove (not shown) and the like, passes through housing 12 from entry chamber 14 through lower chamber 16 into upper chamber 18 for exhaustion through a damper system. Disposed within housing 12, and partially forming the aforementioned flow path, is a grease extraction system 20 according to the invention which permits full access to the interior of housing 12, easy cleaning of filter elements of the system 20, and a fully effective fire wall between the entry chamber 14 and the upper chamber 18.

An access door or hatch 22 provided with a pair of manipulating knobs 24 is disposed on the upper portion of housing 12 in a suitable manner for selective removal in order to permit access to upper chamber 18. As can be seen from FIG. 2, however, the usual dimensions of housing 12, together with the presence of the water spraying system within housing 12 do not permit ready access from the vicinity of hatch 22 to lower chamber 16 and the transition area between chamber 16 and upper chamber 18.

Disposed atop housing 12 so as to surround an opening provided for exhausting air from upper chamber 18 is a damper frame 26. In this frame is rotatably mounted a damper 28 as by a shaft 30 journaled on opposed ends of frame 26. A box 32 mounted on one of the ends of shaft 30 contains a conventional torsion spring (not shown) which will cause damper 28 to automatically assume a closed position within frame 26 whenever a thermal fuse 34 becomes overheated, as by a fire in housing 12, and releases damper 28 against the bias of the torsion spring. Also disposed in damper frame 26 is a thermostat 36 which will actuate a spray system when a predetermined temperature is reached within damper frame 26.

The aforementioned spray system includes the illustrated manifolds 38, 40 and 42 each provided with one or more spray nozzles 44 and connected to a source of water, and the like, by pipes 46 and 48. Suitable brackets 50 and 52 connected to interior walls of housing 12 help support the spray system within the unit.

Ventilator 10 is shown as having associated therewith a canopy C of a conventional nature. It is to be understood that the ventilator 10 may be used with a plate warmer arrangement (not shown) also of conventional construction, if desired.

A grease extraction cartridge 54, according to the present invention, is shown as disposed in an opening provided opposite the dividing line between chambers 14 and 16. Cartridge 54 includes supports 56 which are perpendicular to a plurality of planar, codirectionally extending wall members 60 and 64 connected to supports 56. Although two supports 56 are necessary (one removed in FIGS. 1 and 2 for clarity), it is to be understood that additional supports 56 may be used as structural needs require. Mounted on the supports 56 so as to extend therefrom codirectionally with the wall members 60 and 64 are shown a plurality of airfoils 66 arranged for changing the direction of flow of fluid passing over the airfoil 66 in order to cause grease, and the like, present in the air to be deposited on the surface of the airfoil 66.

Figure 4:
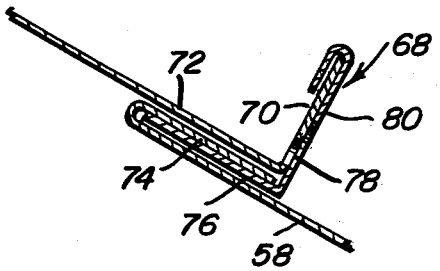
FIG. 4 is an enlarged, fragmentary, detail view, partly cut away in a section, showing the circle portion designated A of FIG. 2.

Cartridge 54 is mounted on housing 12 so as to form a dividing wall between the entry chamber 14 and the upper chamber 18, and placing upper chamber 18 in direct communication with the entry chamber 14 for purposes of cleaning the housing and maintaining the unit when cartridge 54 is removed from housing 12. For purposes of removably mounting cartridge 54 within housing 12, a connector 68 (FIG. 4) is provided on a lip 70 of a wall 72 which cooperates with the wall member 58 of cartridge 54 to form the fire wall of the ventilator 10. A peripheral portion 74 of wall member 58 of cartridge 54 is bent back upon itself so as to form a substantially U-shaped catch which is selectively arrangeable receiving a leg 76 of the connector 68 so that the cartridge 54 is effectively hung from the interior of housing 12. An aperture 78 is preferably provided through the lip 70 of wall 72 and the leg 80 of connector 68 so as to permit drainage of water sprayed within housing 12.

Figure 5:
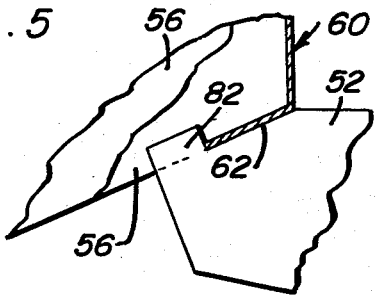
FIG. 5 is an enlarged, fragmentary, detail view, partly cut away and in section, showing the circle portion designated B of FIG. 2.
Figure 6:
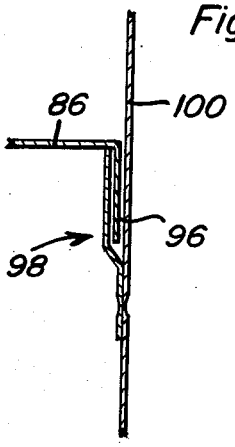
FIG. 6 is an enlarged, fragmentary, sectional view taken generally along the line 6—6 of FIG. 3.

As can be seen from FIG. 5, the cartridge 54 is also supported by the bracket 52 which partially supports the spray system of the invention. The lip 62 of wall 60 when engaged with the tab 82 provided on bracket 52 will insure that the cartridge 54 stays in place.

The grease extraction system 20 further includes an additional grease extraction cartridge 84 which, in a manner similar to cartridge 54, includes a support 86 on which are mounted perpendicular to the plane of support 86 a plurality of codirectionally extending planar wall members 88, 90, 92, and 94. A single airfoil 66 is illustrated as being mounted on support 86 so as to extend parallel to the wall members 88, 90, 92, and 94.

Cartridge 84 is mounted in housing 12 between lower chamber 16 and upper chamber 18 as by an arrangement including a pair of slides 96, only one of which is shown in the drawings, extending perpendicularly from a preferable portion of the support 86 and engaging in associated slide guides 98, also only one of which is shown, mounted on a wall portion 100 of housing 12 so that the cartridge 54 will slide up against the wall portion 102 which is at an acute angle with respect to wall portion 100, and be retained within the back portion of housing 12. As can be seen from FIG. 3, when cartridge 54 is removed from housing 12, there is direct access in the direction of the direction arrow shown in FIG. 3 to the position of the cartridge 84 mounted at the rear of housing 12.

An exhaust fan (not shown) is connected to ventilator 10, with the latter also being furnished with a semi or fully automated control panel, also not shown, from which ventilator 10 will be operated. The thermostat 36 is connected to the control panel, and will activate the water spray system automatically in case of high fire dangerous temperatures.

The piping of ventilator 10 will be connected to existing hot water lines (not shown) in an associated building, with a solenoid valve (not shown) inside the control panel and various timing devices (not shown) enabling a person to, in a known manner, activate the wash and rinse system at the push of a button. Actuation of a switch associated with the button will activate the exhaust fan, water wash, rinse, and fire cycles, and in case of a fire, the exhaust fan will stop and the water spray system come on automatically by means of a control system of conventional construction.

If a fully automatic control panel is employed, the cycles will all be programmed and the ventilator will function in a fully automatic mode.

A drain 104 is disposed in the bottom of housing 12 in order to permit discharge of the waste water created in the water wash, rinse and fire cycles.

Housing 12 is provided with a baffle 106 having a portion 108 hooked about manifold 40 and a peripheral portion 110 double backed on itself in order to fit over a lip 112 provided on an adjacent portion of housing 12 in order to permit selective removable of the water and air guide baffle 106, removal of cartridge 54, and access to and removal of cartridge 84.

As can be readily understood from the above description and from the drawings, a grease extraction cartridge system, according to the present invention, permits construction of a kitchen exhaust ventilator which is highly efficient and effective, yet is easily maintained and cleaned.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a kitchen exhaust ventilator including a housing divided into a first chamber, a second chamber, and a third chamber, with the three chambers being in serial communication with one another and defining a flow path through the housing passing from the first chamber through the second chamber and into the third chamber, and a grease extraction system disposed for partially forming the flow path, the grease extraction system including a grease extraction cartridge removably mounted on the housing, the improvement wherein the grease extraction cartridge forms the flow path entirely through the first chamber of the housing, the cartridge comprising a common fire wall separating the first chamber and third chamber, and the cartridge including a support, an airfoil mounted on the support and arranged for changing the direction of a flow of fluid passing over the airfoil and causing foreign matter to be separated from the fluid and deposited on the airfoil, and connector means provided on the housing for removably mounting the fire wall thereto in the housing of the ventilator so that the cartridge may be removed thereby placing the third chamber in direct communication with the first chamber for purposes of cleaning and maintaining the housing.

2. An improvement as defined in claim 1, wherein the grease extraction system further includes a further grease extraction cartridge mounted in the housing between the second chamber and the third chamber so as to partially form the flow path, access to the further cartridge being provided by removal of the cartridge from the housing.

3. An improvement as defined in claim 2 wherein the further cartridge is removably mounted in the housing of the ventilator.

4. An improvement as defined in claim 1, wherein the grease extraction system further includes a further grease extraction cartridge mounted in the housing between the second chamber and the third chamber so as to partially form the flow path.

* * * * *